US009341330B2

(12) United States Patent
Ho

(10) Patent No.: US 9,341,330 B2
(45) **Date of Patent: *May 17, 2016**

(54) WIDE-ANGLE LIGHTING DISPLAY DEVICE

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/484,335

(22) Filed: Sep. 12, 2014

(65) Prior Publication Data

US 2016/0076716 A1 Mar. 17, 2016

(51) Int. Cl.

| | |
|---|---|
| ***F21S 10/00*** | (2006.01) |
| ***F21V 7/00*** | (2006.01) |
| ***F21V 23/02*** | (2006.01) |
| ***F21V 29/83*** | (2015.01) |
| ***F21V 3/04*** | (2006.01) |
| ***F21V 17/06*** | (2006.01) |
| *F21W 121/00* | (2006.01) |
| *F21Y 101/02* | (2006.01) |

(52) U.S. Cl.

CPC ..... *F21S 10/002* (2013.01); *F21V 3/0472* (2013.01); *F21V 7/0025* (2013.01); *F21V 17/06* (2013.01); *F21V 23/02* (2013.01); *F21V 29/83* (2015.01); *F21W 2121/00* (2013.01); *F21Y 2101/02* (2013.01)

(58) Field of Classification Search

CPC .... F21S 10/002; F21V 29/183; F21V 3/0472; F21V 7/0025; F21V 17/06; F21V 23/02; F21W 2121/00; F21Y 2101/02

See application file for complete search history.

(56) References Cited

U.S. PATENT DOCUMENTS 8,911,101 B2 * 12/2014 Tsai ..... F21V 9/12 362/101
2014/0003036 A1 * 1/2014 Ho ..... F21S 10/002 362/101

* cited by examiner

*Primary Examiner* — Mary Ellen Bowman
(74) *Attorney, Agent, or Firm* — Rosenberg, Klein & Lee

(57) ABSTRACT

A wide-angle lighting display device with the features of its original patent application displays an unlimited extension of an inward serial arrangement from the middle, and further displays an extended visual effect at an oblique angle, enlarging the display area thereof; also, the structure thereof is easier to be maintained and renovated.

10 Claims, 13 Drawing Sheets

WIDE-ANGLE LIGHTING DISPLAY DEVICE

This patent application is a continuation-in-part of Ser. No. 13/925,979 filed on Jun. 25, 2013, currently pending.

BACKGROUND OF THE INVENTION

1. Field of the Invention

The present invention relates to a wide-angle lighting display device, particularly to one that not only has features of the original patent application but can further display extended visual effects at an oblique angle; also, the structure thereof is easier to be maintained and renovated.

2. Description of the Related Art

A lava lamp display device 80 disclosed in U.S. Pat. No. 3,570,156 comprises a glass vessel 81 having a bottom 82 arranged in a hollow conical metallic seating 83 and located on an electric light bulb 84. Moreover, the glass vessel 81 has two immiscible components, for example, liquid 85 and a paraffin 86 which has a high density than the liquid 85 at room temperature and a lower density than the liquid 85 after heating. After the electric light bulb 84 is turned on, the paraffin 86 at the bottom 82 of the glass vessel 81 is heated and flows in the liquid 85. At the same time, the electric light bulb 84 projects the light to the glass vessel 81, forming a lighting effect which becomes a decoration at homes and offices. In addition, if a plurality of glitters are put together with the liquid 85, the glitters would move and flow with the liquid 85; such application is called a glitter lamp. However, the lava lamp display device 80 or the glitter lamp only has lighting effects in a single glass vessel 81. As a decoration, it seems to be monotonous and lacking of visual effects.

Also, in the original U.S. patent application Ser. No. 13/925,979 there is a water dancing speaker 90, comprising a base 91 with a speaker 93 thereon, a transparent bottle 92 being able to emit lights, a power cord 96, an audio cable 95 and a plurality of projection hole. When the music is on, the projection holes sprays water and emits light according to the music beats. This water dancing speaker is the same as the lava lamp display device. They are both decorations with lighting and water-flow changes inside a single transparent bottle only. Therefore, the water dancing speaker seems to be monotonous and lacking of visual effects as well. In other words, there is still room for improvement in these devices.

Still, the mentioned original US Patent application discloses a permeable vision window in the middle of the front side of the frame to displace the lighting object which forms an unlimited extension of an inward serial arrangement from the middle when the non-parallel reflection surfaces are reflected repeatedly, making the invention as a lamp and decoration with special visual effects. However, the vision window is only a small area at the front side of the lamp, and the maintenance and renovation of the transparent bottle arranged inside is inconvenient, leaving the invention to be improved as well.

SUMMARY OF THE INVENTION

A primary object of the present invention is to provide a wide-angle lighting display device that has features of its original patent application, displaying an unlimited extension of an inward serial arrangement from the middle when the non-parallel reflection surfaces are reflected repeatedly, and further displays extended visual effects at an oblique angle; also, the structure thereof is easier to be maintained and renovated To achieve the object mentioned above, the present invention comprises a frame including a pedestal on which a front frame body and a rear frame body are arranged; a film-coated glass mounted on the front frame body and having the front side with light transmittancy facing towards the front frame body as a window surface and the back side with reflectivity; a lower fixing seat arranged on the pedestal, between the front frame body and the rear frame body; a support bracket with one end arranged on the pedestal and the other end connected to an upper fixing seat which has an upper engaging room inside, having a containing height of at least 5 cm with a downward opening, and the upper and lower fixing seats to be vertically located along an axis on the pedestal; a lighting object having at least a transparent bottle being able to emit light effects and to be disposed between the upper and lower fixing seats, corresponding to the height of the window surface; a first reflection mirror and a second reflection mirror fixed on the rear frame body, located at the rear side of the lighting object and having the reflection surfaces thereof facing forward, and a center thereof serving as a reference to define the first and second reflection mirrors symmetrically, inclined to form an angle θ between 145° and 175°, so that the window surface would display an unlimited extension of an inward serial arrangement from the middle after the contents of the transparent bottle are reflected repeatedly and cumulatively by the first and second reflection mirrors; and a cover plate disposed on the rear frame body, behind the first and second reflection mirrors.

In a preferred embodiment, the present invention further includes an assembling element arranged between the lighting object and the lower fixing seat, having a hollow engaging room inside to engage with the bottom of the lighting object so that when the upper end thereof is moved upwards to the upper engaging room to a predetermined height, moving the lighting object downwards, making it securely positioned between the upper and lower fixing seats, by which the lighting object can be installed or removed along the vertical axis of the pedestal with the design of the engaging rooms.

In an applicable embodiment, the lighting object can be a water dancing lamp, a lava lamp, or a glitter lamp. Moreover, the present invention includes a projecting lamp disposed inside the lower fixing seat and obtaining electric power from a power supply disposed inside the pedestal. Furthermore, the bottom of the transparent bottle contacts with the top of the LED light where a heat conductive paster is arranged thereon in order to conduct the heat to the transparent bottle.

Besides, the support bracket thereof has a lighting source arranged thereon, and the support bracket is hollow for the power supply to connect to an electric wire through which to supply the electric power for the lighting source. In addition, the first and second mirrors behind the rear frame body form an angle θ and have two symmetrical inclined surfaces to form a pre-determined slope when they are joined together. Further, the lower part of the one of the assembling element has an engaging section with shorter diameter than the assembling element in order to engage with the lower fixing seat, and the assembling element has a plurality of heat dissipating holes arranged on the periphery thereof.

As structures disclosed above, the present invention has a window surface to enlarge the area of the unlimited extension of an inward serial arrangement from the middle; also, it can further display extended visual effects at an oblique angle, increasing the visual effects of the present invention and widening the visual angle as well. Additionally, the structure of the present invention is easier to be maintained and renovated.

DETAILED DESCRIPTION OF THE PREFERRED EMBODIMENT

Figure 1A:
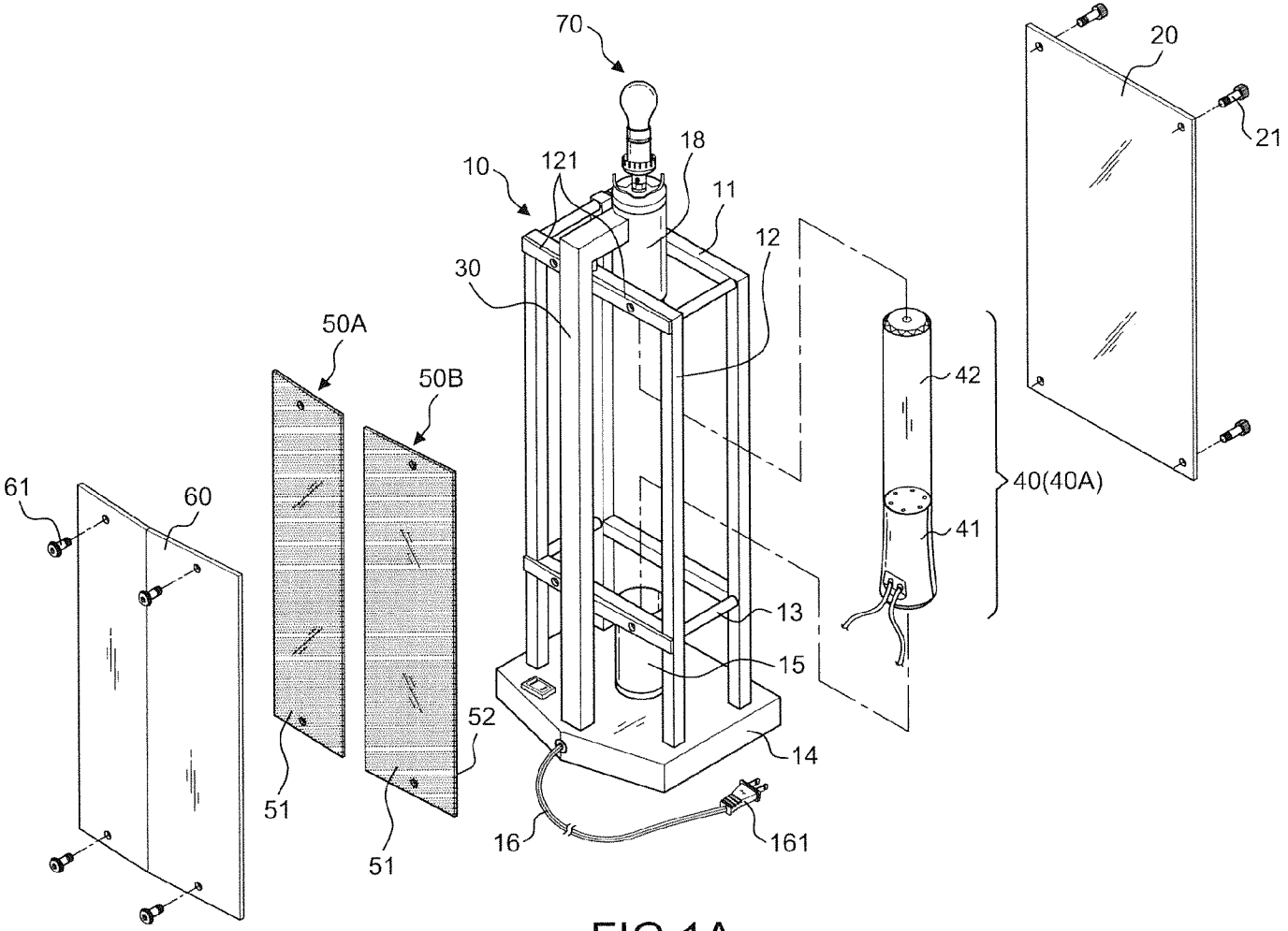
FIG. 1A is an exploded view of the present invention showing from the back at an oblique angle and a water dancing lamp being the lighting object.

Referring to FIGS. 1-8, in a preferred embodiment, the present invention comprises a frame 10, a film-coated glass 20, a lower fixing seat 15, a support bracket 30, a lighting object 40, a first reflection mirror 50A and a second reflection mirror 50B.

The frame 10 includes a pedestal 14 on which a front frame body 11 and a rear frame body 12 are arranged. The front frame body 11 and the rear frame body 12 can be assembled by a plurality of tappets 13 but are not limited to such application.

The film-coated glass 20 is mounted on the front frame body 11 and has the front side with light transmittancy facing towards the front frame body 11 as a window surface 20' and the back side with reflectivity; in other words, the visual area of the present invention is not restricted to a small window but a wide area of a window surface 20'.

Figure 1B:
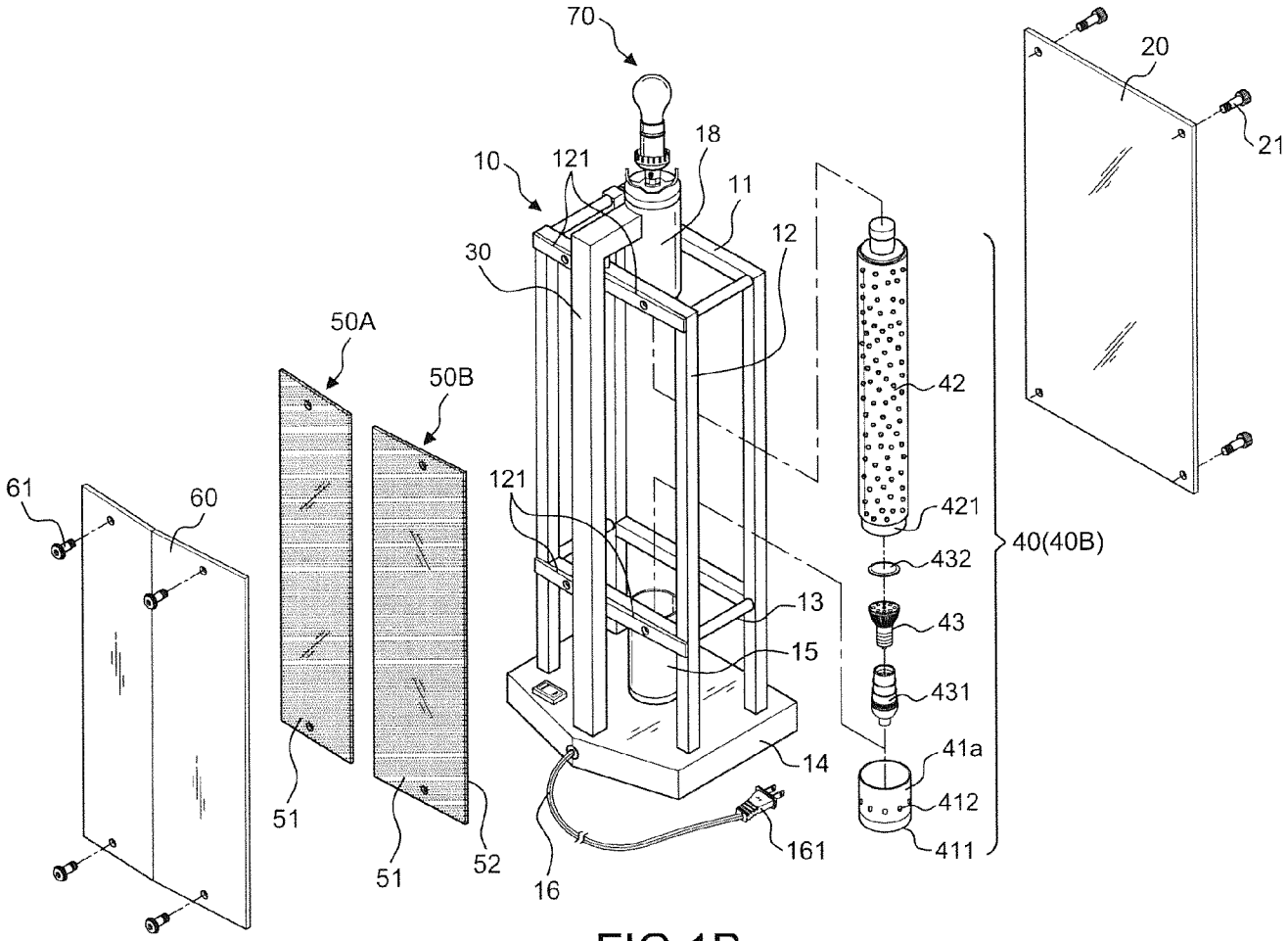
FIG. 1B is an exploded view of the present invention showing from the back at an oblique angle and a glitter lamp being the lighting object.
Figure 2:
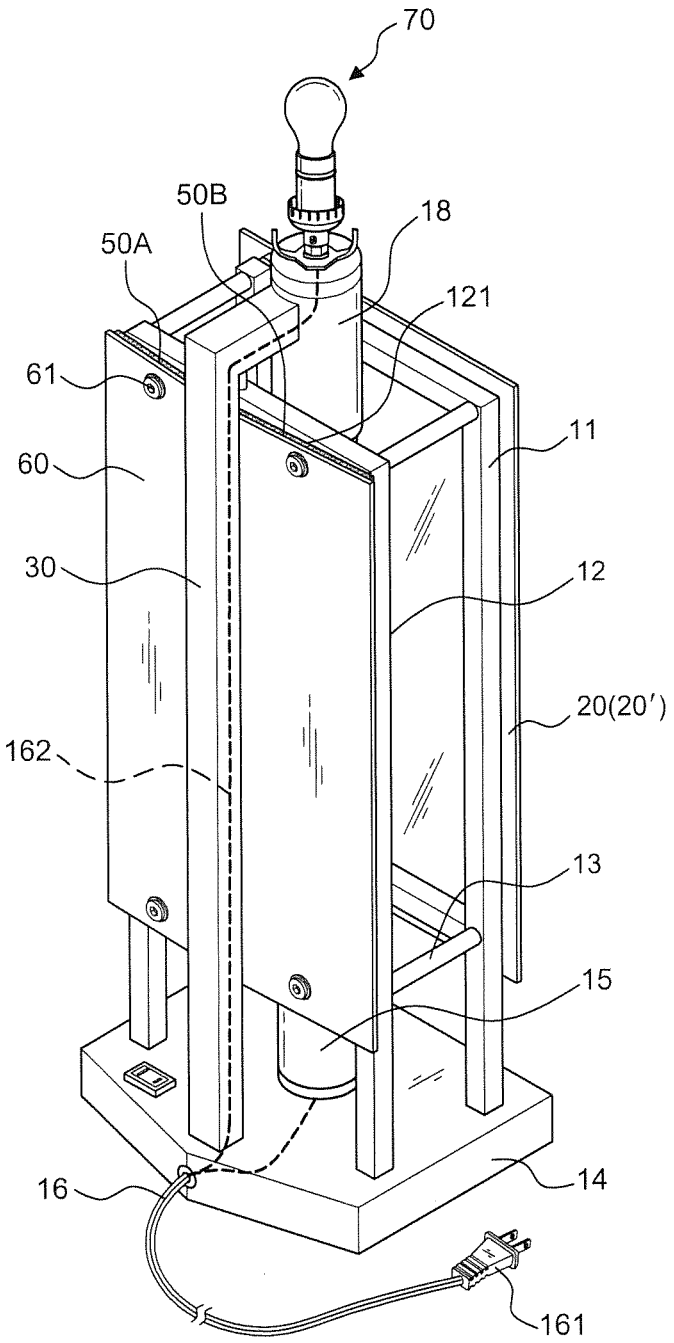
FIG. 2 is a perspective view of the present invention viewing from the back at an oblique angle.
Figure 3:
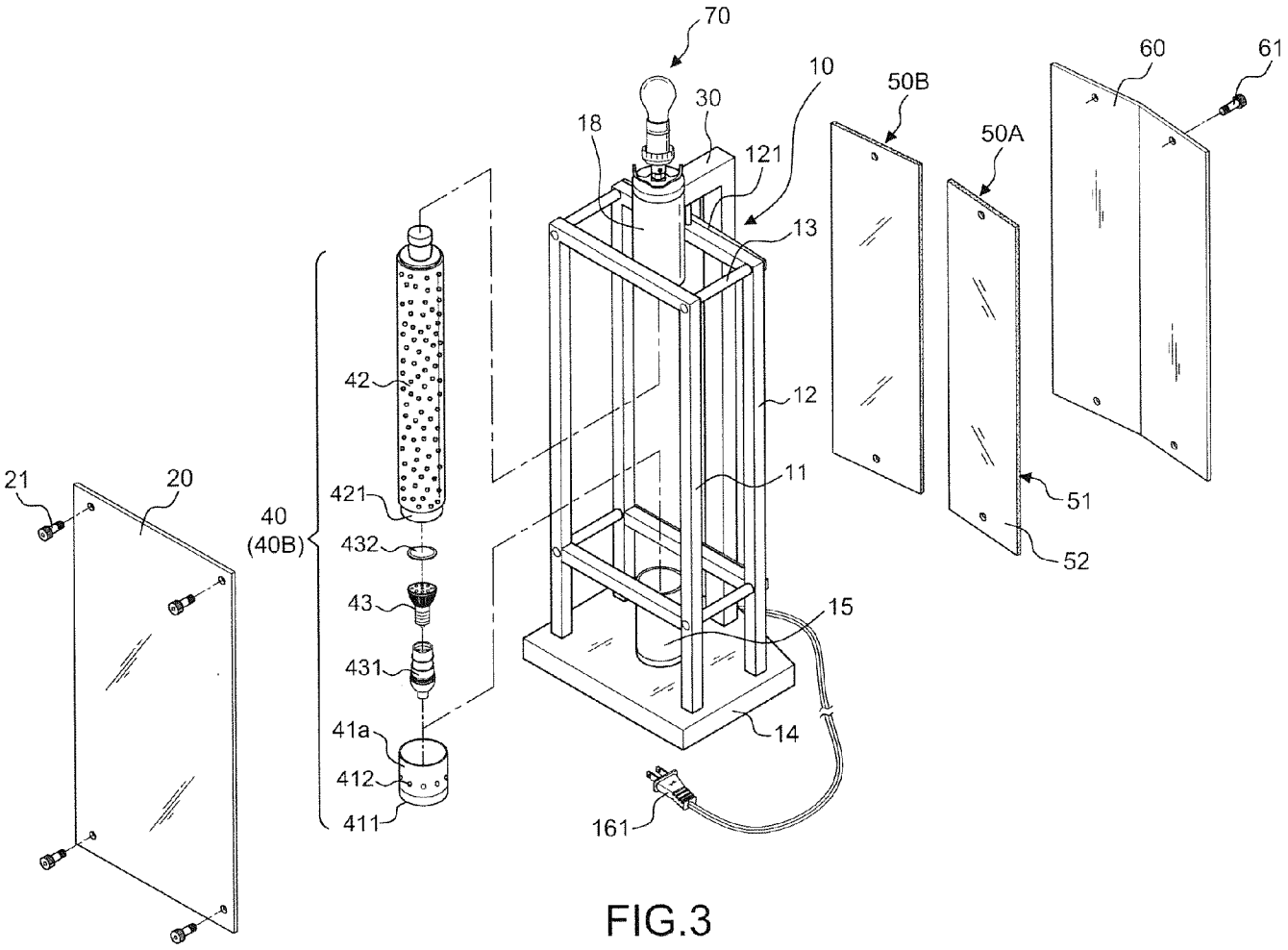
FIG. 3 is an exploded view of the present invention viewing from the front at an oblique angle.

The lower fixing seat 15 is arranged on the pedestal 14, between the front frame body 11 and the rear frame body 12. As shown in FIG. 1B, the lower fixing seat 15 can be hollow for a projecting lamp 43 and a lamp base 431 to be arranged through, so as to be fixed on the pedestal 14, or to be engaged thereon in case of the need for dissembling.

Figure 4:
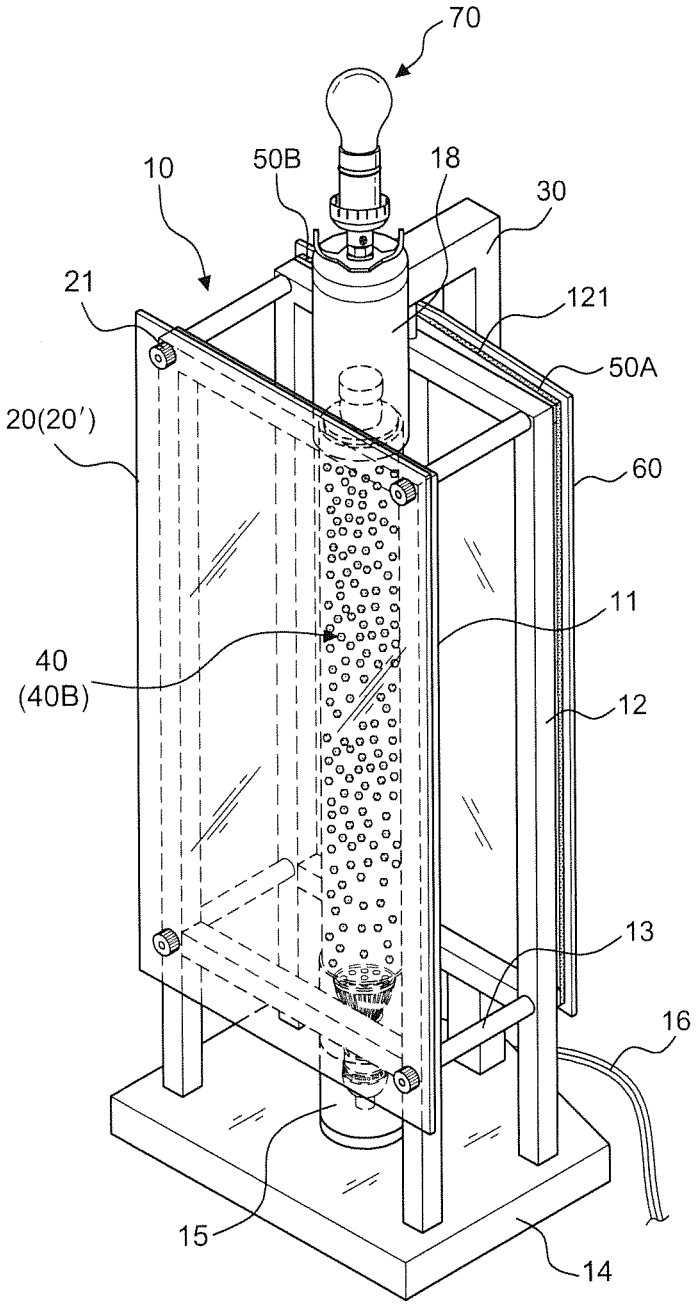
FIG. 4 is a perspective view of the present invention viewing from the front at an oblique angle.
Figure 5:
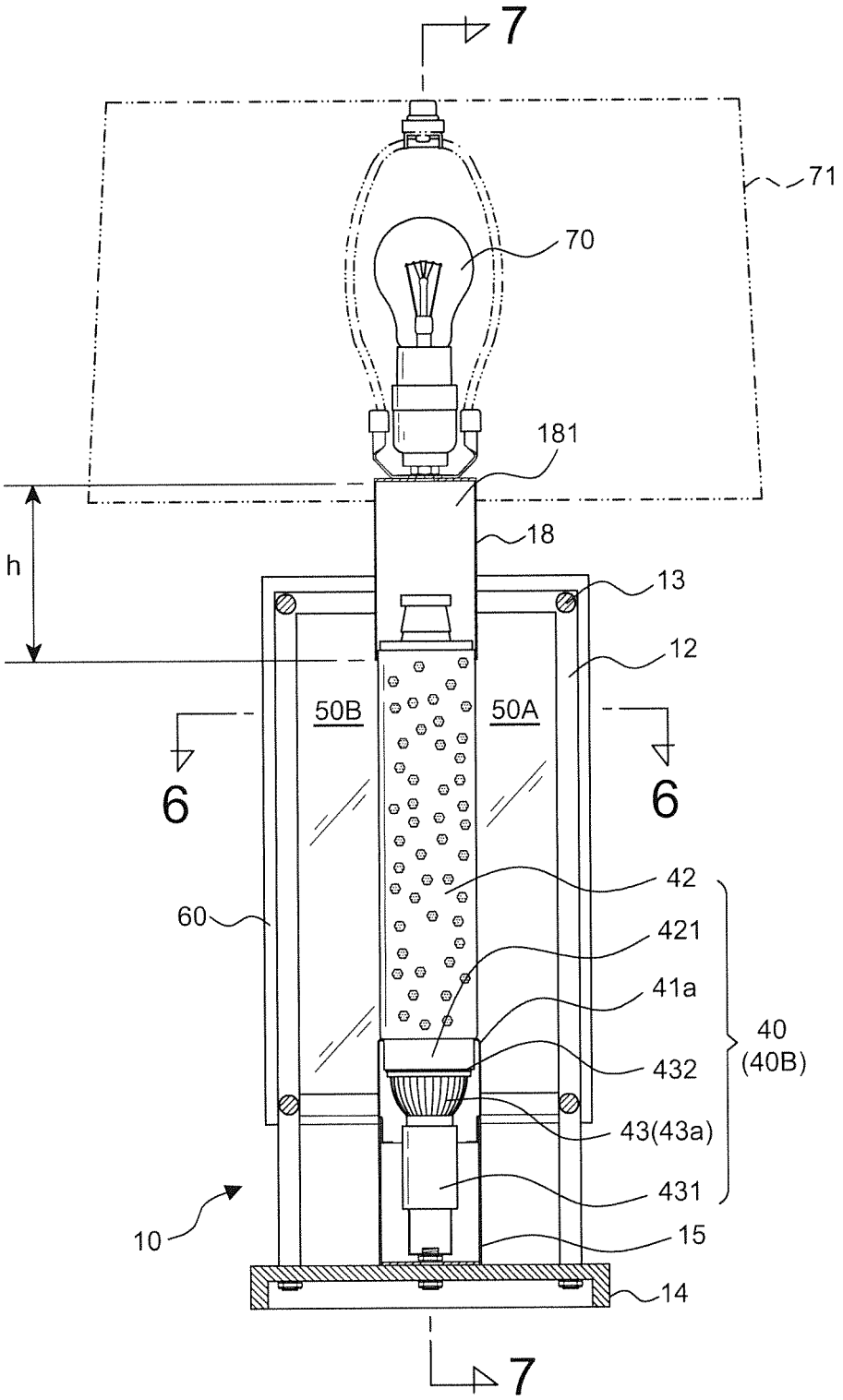
FIG. 5 is a sectional view of the present invention viewing from the front.
Figure 6:
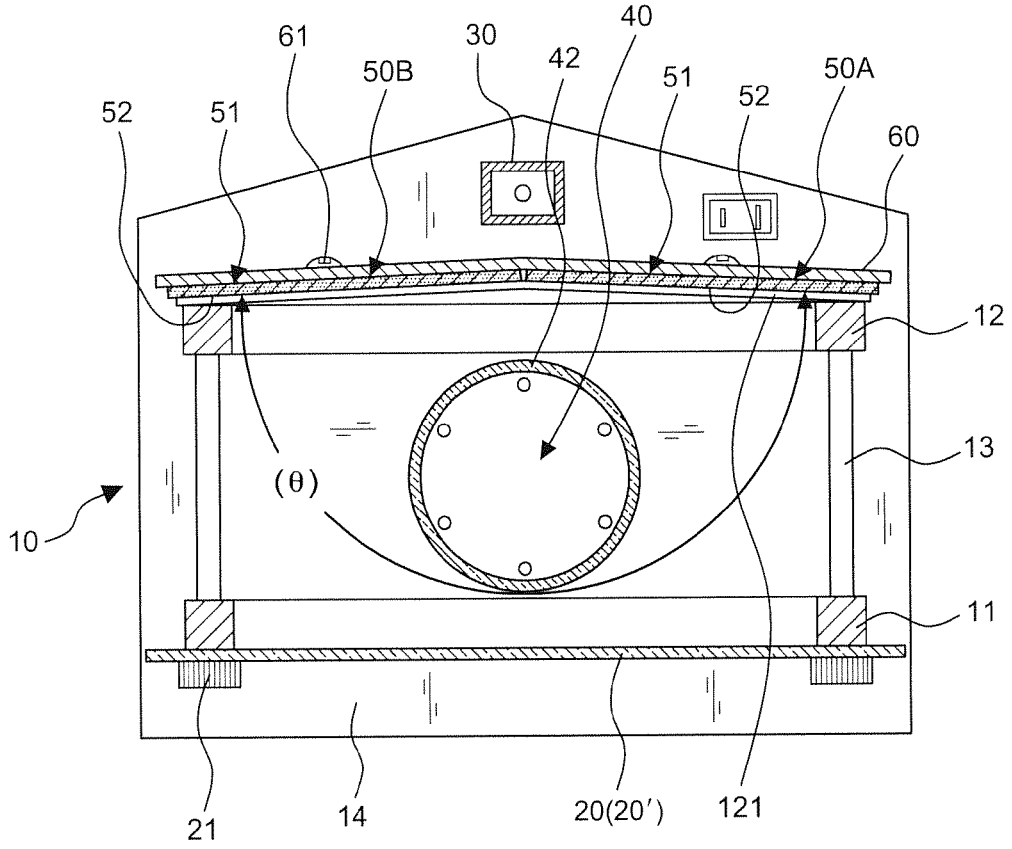
FIG. 6 is a cross-section view along line 6-6 in FIG. 5.
Figure 7:
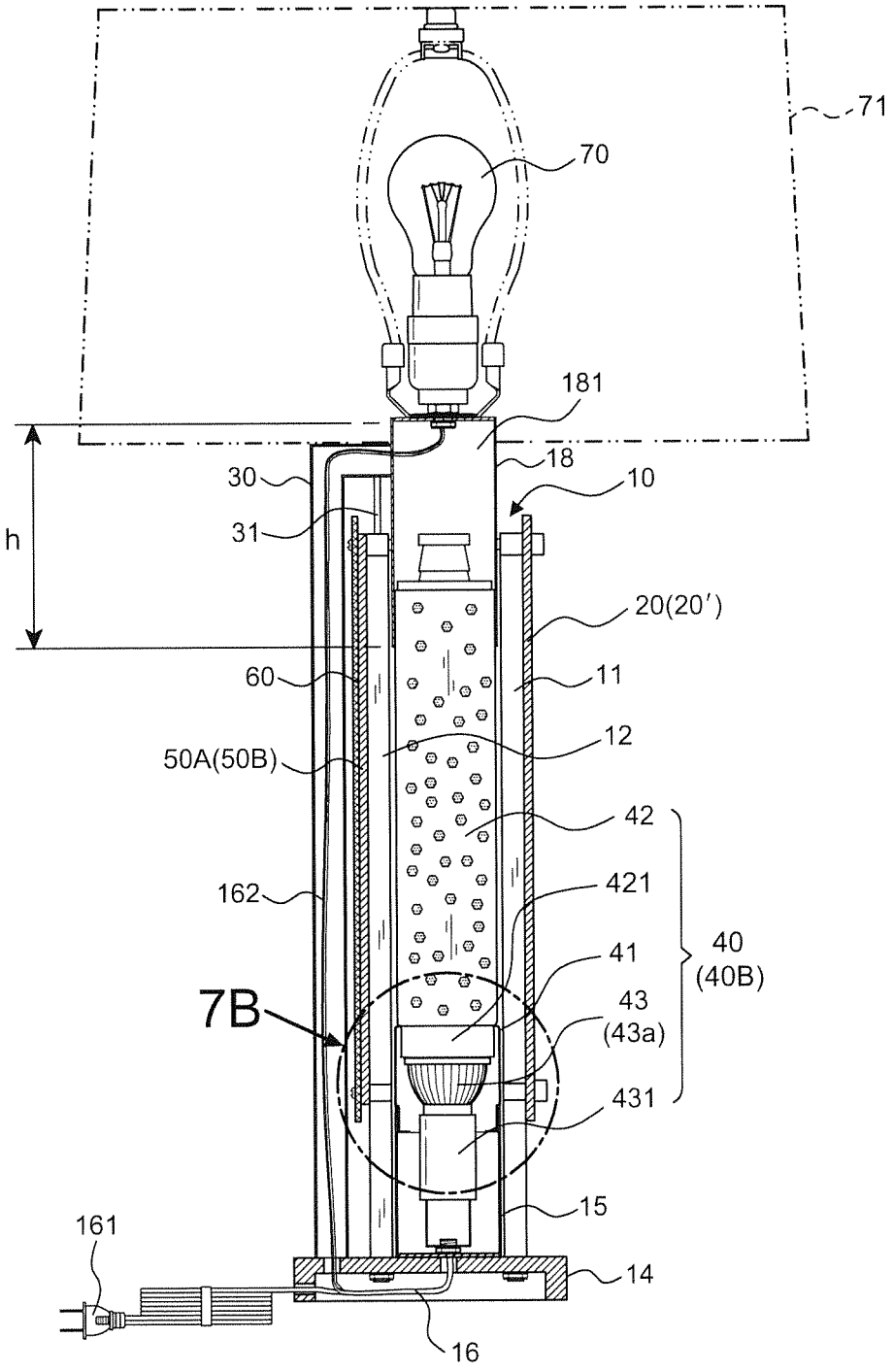
FIG. 7 is a cross-section view along line 7-7 in FIG. 5.

The support bracket 30 has one end arranged on the pedestal 14 and the other end connected to an upper fixing seat 18. As illustrated in FIGS. 4 and 5, the upper fixing seat 18 has an upper engaging room 181 inside, having a containing height h of at least 5 cm with a downward opening, and the upper and lower fixing seats 18, 15 are vertically located along an axis on the pedestal 14. In this embodiment, the support bracket 30 is arranged in an L shape, but is not limited to such application. In FIG. 7, a positioning tappet 31 is arranged between the support bracket 30 and the rear frame body 12 for stability of the support bracket 30.

The lighting object 40 has at least a transparent bottle 42 being able to emit light effects and to be disposed between the upper and lower fixing seats 18, 15, corresponding to the height of the window surface 20'. Referring to FIG. 1A, in this embodiment the lighting object 40 can be a water dancing lamp 40A, and the transparent bottle 42 thereof has a base 41 which has a bottom 413 located on the lower fixing seat 15. Besides, the base 41 has projecting holes for light emitting and water spraying. Such lighting object 40 of water dancing lamp 40A can be found in the original patent application as well.

Figure 7A:
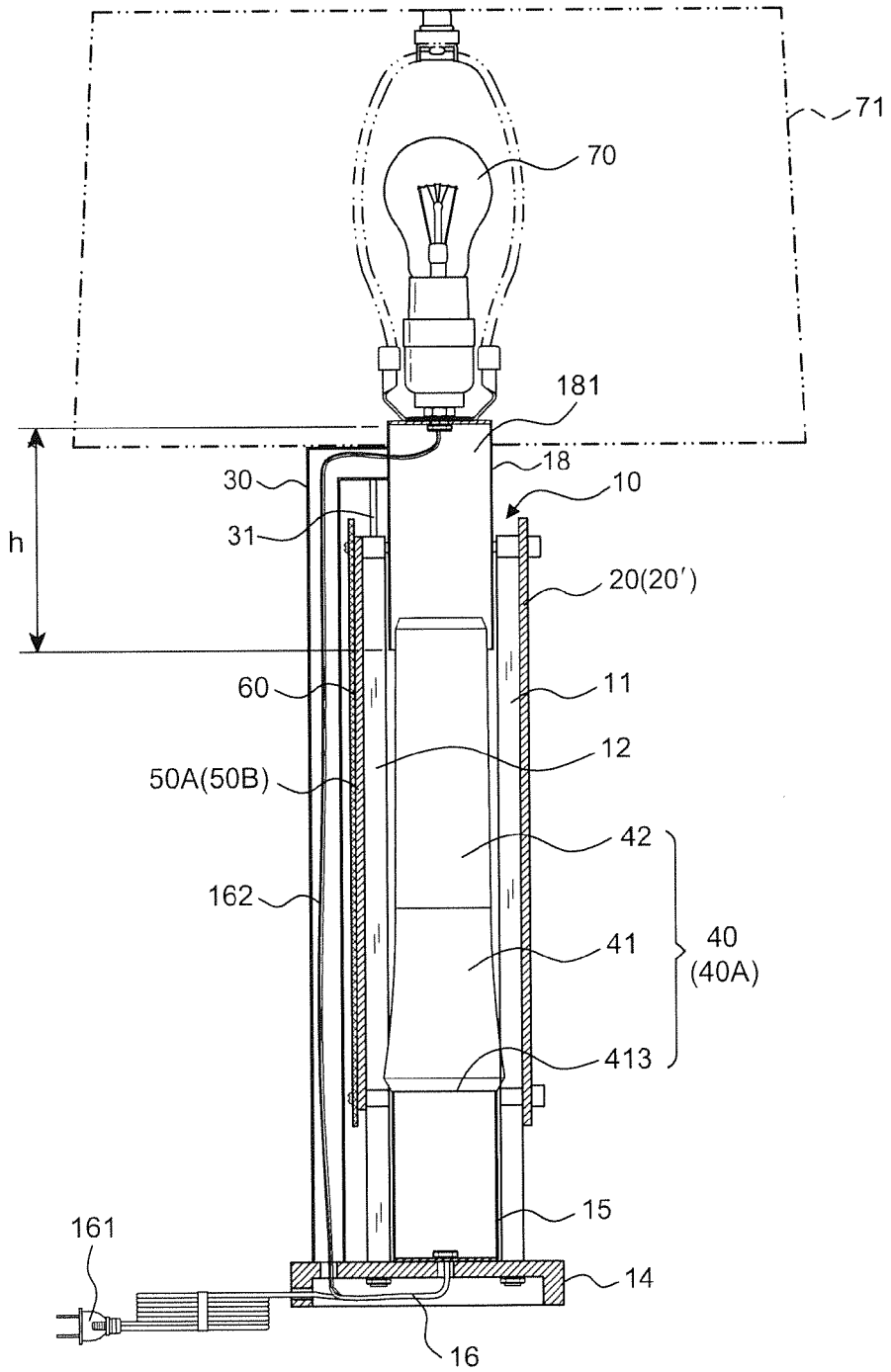
FIG. 7A is a sectional view of the present invention in an embodiment with a water dancing lamp being the lighting object.
Figure 7B:
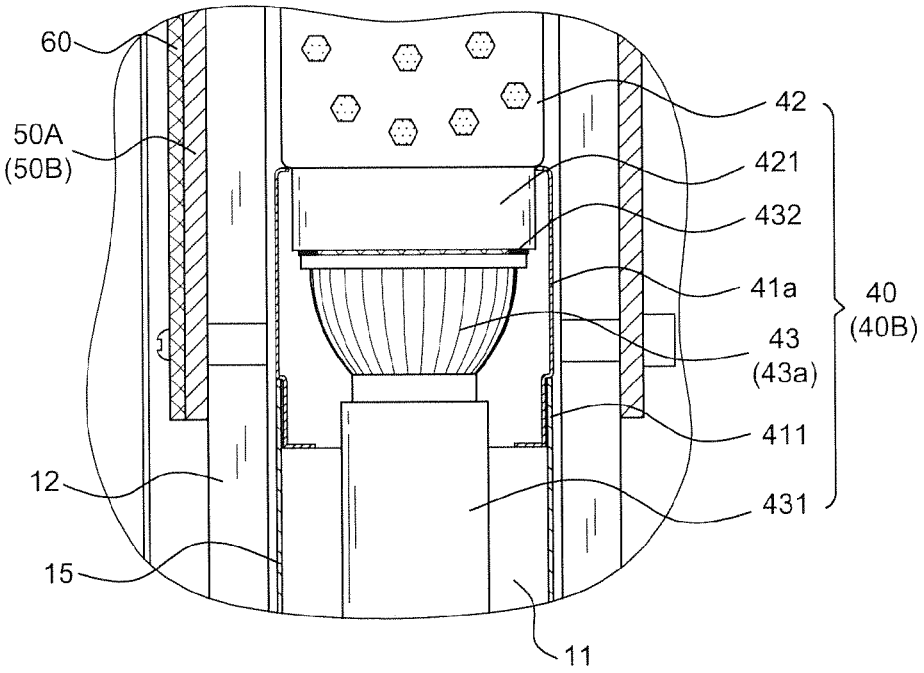
FIG. 7B is a partially enlarged sectional view of FIG. 7.
Figure 7C:
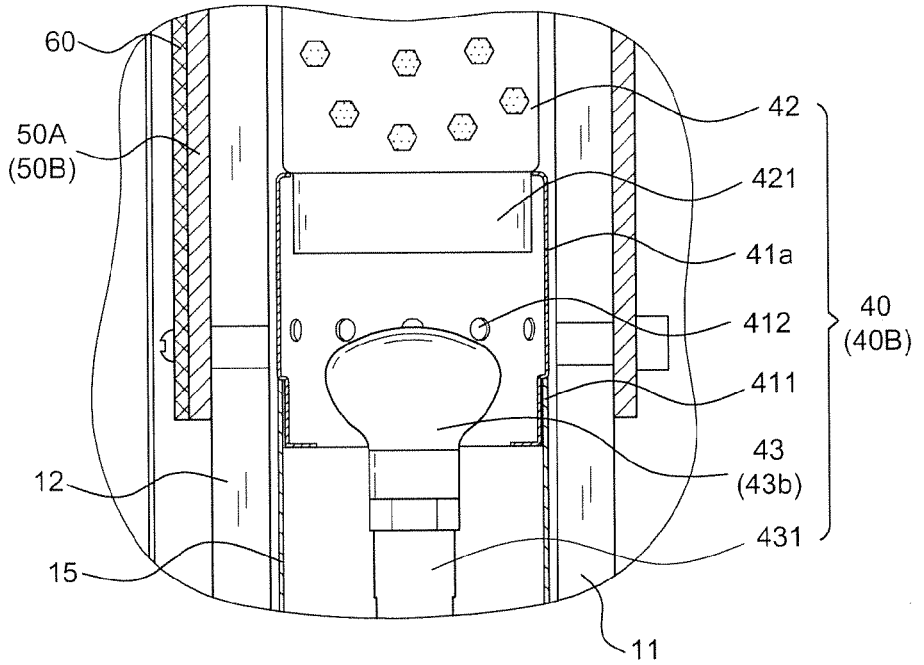
FIG. 7C is an enlarged sectional view of the present invention in another applicable embodiment.

Additionally, with reference to FIG. 1B, the lighting object 40 can be a lava lamp or a glitter lamp 40B, which also has a transparent bottle 42 for light emitting and a projecting lamp 43 arranged below the transparent bottle 42; the projecting lamp 43 can be a LED light 43*a* as shown in FIG. 7B. In this embodiment, the bottom of the transparent bottle 42 is contacting with the top of the projecting lamp 43 (43*a*) where a heat conductive paster 44 is arranged thereon in order to conduct the heat to the transparent bottle 42. Also, the projecting lamp 43 can be a bulb 43*b* as shown in FIG. 7C. In such case, the heat conductive paster 44 is not needed since the bulb 43*b* has higher watts to provide the heat for the contents inside the transparent bottle 42 to flow around.

In short, the lighting object 40 of the present invention can be a water dancing lamp 40A as shown in FIGS. 1A and 7A; or it can be a lava lamp or a glitter lamp 40B as shown in FIGS. 1B and 7.

With structures disclosed above, the structure of lighting object 40 is easy for installing and maintaining. Firstly, moving the upper end thereof upwards to the upper engaging room 181 to a predetermined height, then moving the lighting object 40 downwards, making it securely positioned between the upper and lower fixing seats 18, 15. With such design, the lighting object 40 can be installed or removed along the vertical axis X-X of the pedestal 14.

Since the lighting object 40 needs electric power, a power supply 16 can be disposed inside the pedestal 14 to provide the electric supply for the projecting lamp 43 of the glitter lamp 40B or the water dancing lamp 40A. As presented in FIG. 1A, the power supply 16 can be a transformer or an electric supplier (not shown) disposed inside the pedestal 14; connecting to an external electric wire 161 and an external transformer is also applicable.

The first reflection mirror 50A and a second reflection mirror 50B are fixed on the rear frame body 12 and located at the rear side of the lighting object 40. The back sides thereof are spread over a layer of reflector 51 and the reflection surfaces 52 thereof are facing forward; a center thereof serves as a reference to define the first and second reflection mirrors 50A, 50B symmetrically, inclined to form an angle θ between 145° and 175°, so that the window surface 20' would display an unlimited extension of an inward serial arrangement from the middle after the contents of the transparent bottle 42 are reflected repeatedly and cumulatively by the first and second reflection mirrors 50A, 50B; the cover plate 60 is disposed on the rear frame body 12 and behind the first and second reflection mirrors 50A, 50B. In this embodiment, the cover plate 60 is fixed on the inclined faces 121 of the rear frame body 12 together with the first and second reflection mirrors 50A, 50B by a plurality of positioning elements 61. The cover plate 60 functions as a protection for the first and second reflection mirrors 50A, 50B. The surface area of the cover plate 60 is larger than the ones of the first and second reflection mirrors 50A, 50B, so as to protect them from external impacts.

In a preferred embodiment, the present invention further includes an assembling element 41*a* arranged between the lighting object 40 and the lower fixing seat 15, making it easier for maintenance and renovation, especially when the lighting object 40 is a lava lamp or a glitter lamp 40B; the transparent bottle 42 thereof is filled with heat-sensitive liquid that would flow around and has an inserted section 421 to engage with the assembling element 41*a*. The assembling element 41*a* has a hollow space on the inner periphery to engage with the bottom of the lighting object 40 (40B) so that when the upper end thereof is moved upwards to the upper engaging room 181 to a predetermined height, moving the lighting object 40 (40B) downwards, making it securely positioned between the upper and lower fixing seats 18, 15, by which the lighting object 40 can be installed or removed along the vertical axis of the pedestal 14 with the design of the upper engaging room 181. In this embodiment, the lower part of the one of the assembling element 41*a* has an engaging section 411 with shorter diameter than the assembling element 41*a* in order to engage with the lower fixing seat 15, and the assembling element 41*a* has a plurality of heat dissipating holes 412 arranged on the periphery thereof. Nevertheless, when the lighting object 40 is a water dancing lamp 40A as shown in FIGS. 1A and 7A, there is no need for the assembling element 41*a*. The water dancing lamp 40A is directly engaging on the lower fixing seat 15 since the projecting lamp 43 and other related elements are already disposed inside the base 41.

Further, in a preferred embodiment, the support bracket 30 is hollow for the power supply 16 to connect to an electric wire 162 through which to supply the electric power for a lighting source 70 arranged on top of the support bracket 30; a lampshade 71 is further disposed thereon, making the present invention a lighting fixture.

Moreover, the first and second mirrors 50A, 50B behind the rear frame body 12 form an angle θ and have two symmetrical inclined surfaces 121 to form a pre-determined slope when they are joined together. In an applicable embodiment, the angle θ between 145° and 175° is the most preferred angle, repeatedly and cumulatively reflecting at least 6 reflections of the transparent bottle 42 and displaying an extended three-dimensional visual effect.

Figure 8:
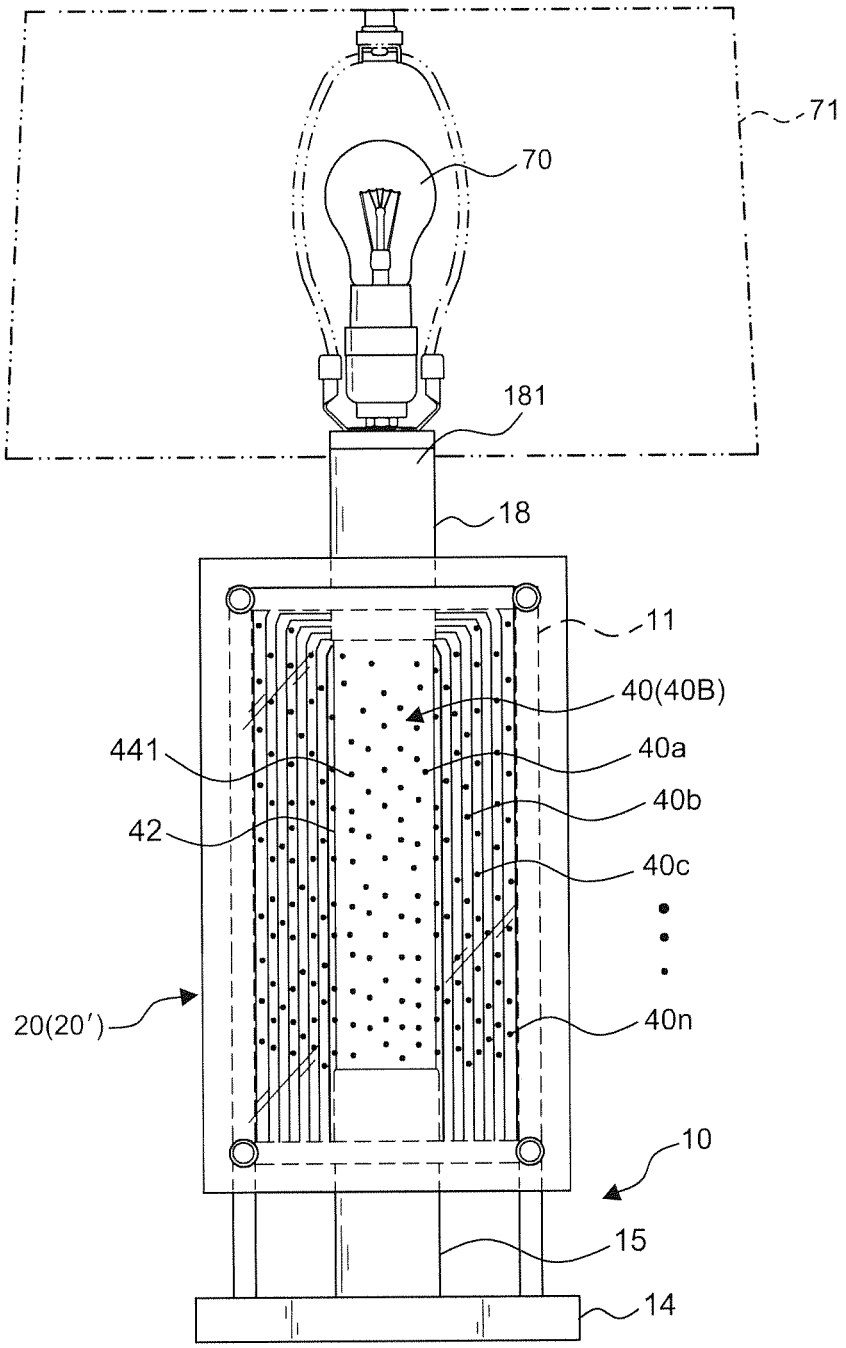
FIG. 8 is a practical application view of the present invention.
Figure 8A:
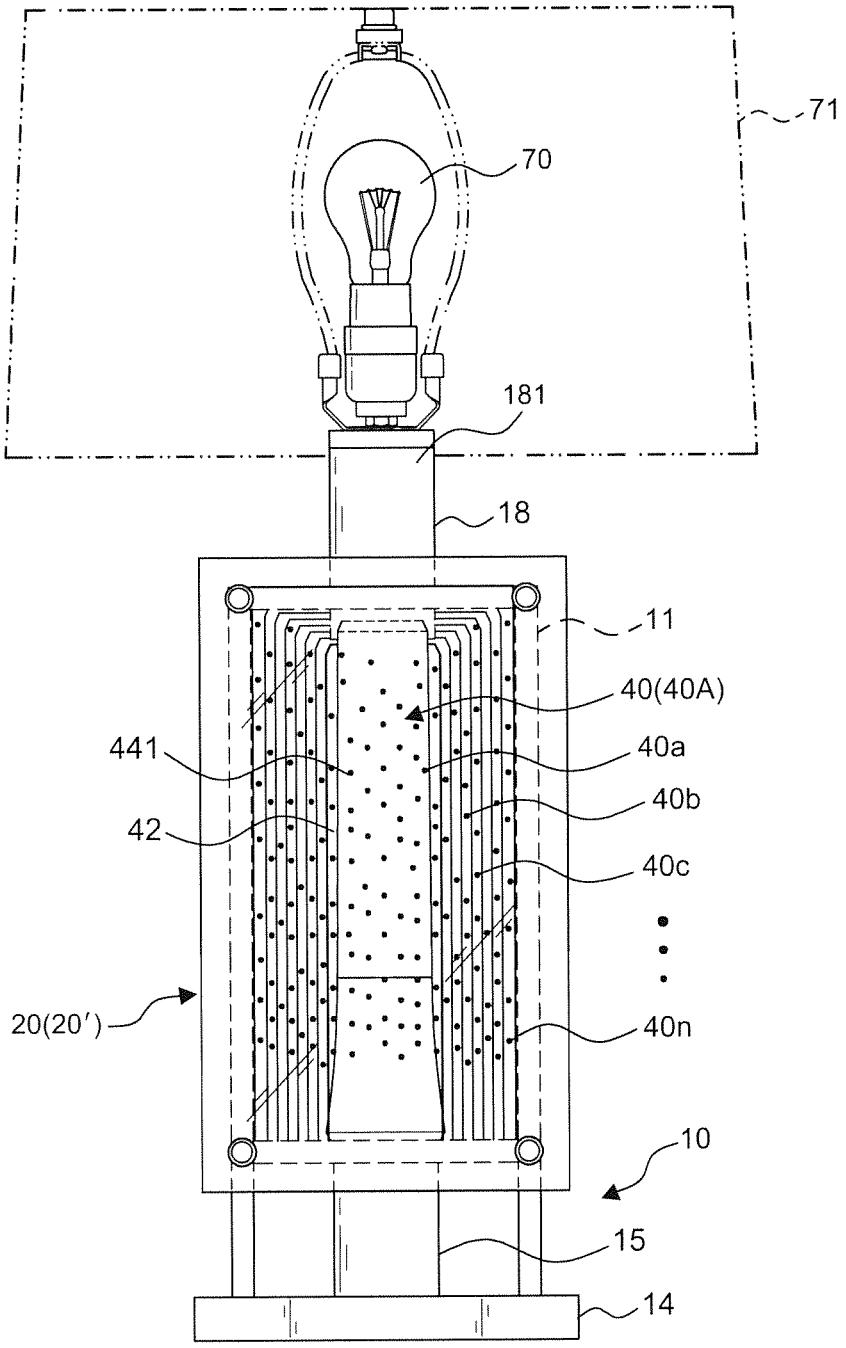
FIG. 8A is another practical application view of the present invention.
Figure 9:
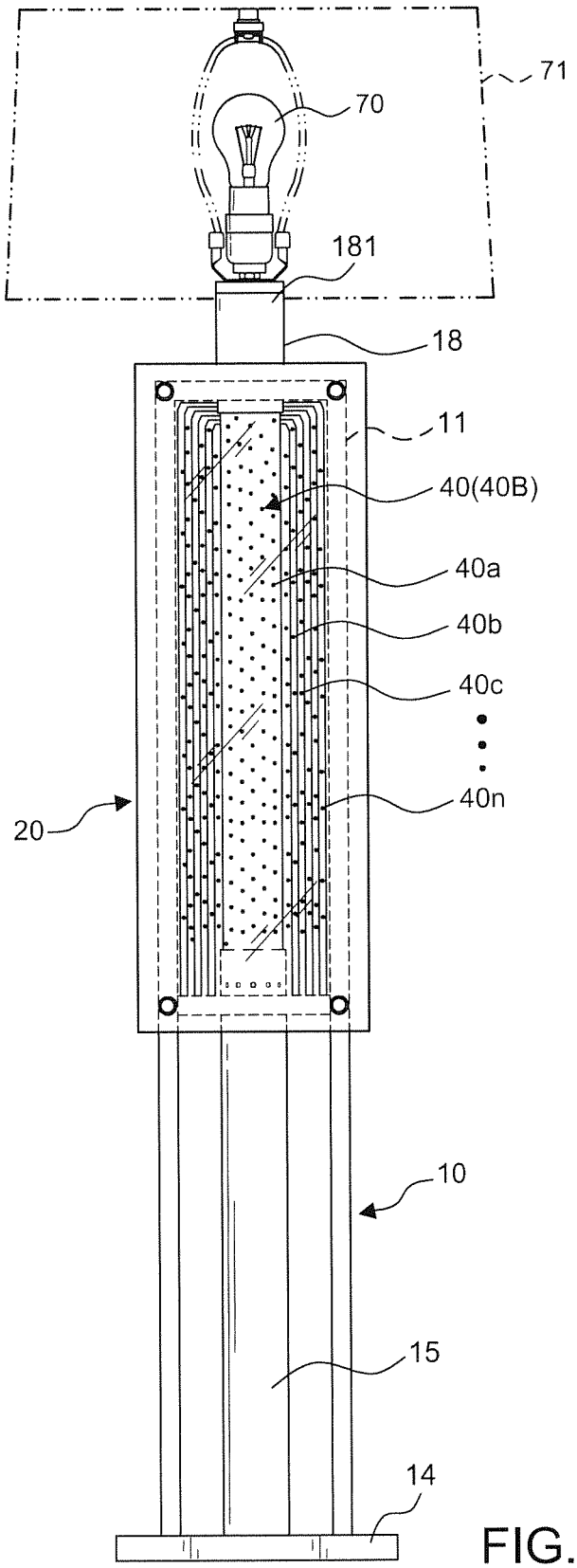
FIG. 9 is yet another practical application view of the present invention.

FIGS. 8 and 8A illustrate the practical applications of the present invention. When the present invention is turned on, the transparent bottle 42 of the lighting object 40, either glitter lamp 40B or water dancing lamp 40A, would display visual effects 441 made by lights, spraying water and water flow. When the lighting object 40 is placed between the film-coated glass 20 and the first and second mirrors 50A, 50B as presented in FIG. 6, the visual effects 441 of the single transparent bottle 42 would be reflected repeatedly and cumulatively as shown in FIGS. 8 and 8A, displaying an unlimited extension of an inward serial arrangement from the middle 40*a*, 40*b*, 40*c*, . . . 40*n*. The reflection is rich in visual effects instead of being a monotonous display. Therefore, the present invention is a lighting fixture and meanwhile an artistic ornament of special visual effects. As for the practical application view in FIG. 9, the structure is the same as the embodiments disclosed above, except the frame 10 is arranged as a standing structure.

With structures disclosed above, the present invention can not only display an unlimited extension of an inward serial arrangement from the middle, but can further display extended visual effects at an oblique angle, enlarging the display area thereof and enriching the visual effects as well; also, the structure thereof is easier to be maintained and renovated.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A wide-angle lighting display device comprising:

a frame including a pedestal on which a front frame body and a rear frame body are arranged;

a film-coated glass mounted on the front frame body and having the front side with light transmittancy facing towards the front frame body as a window surface and the back side with reflectivity;

a lower fixing seat arranged on the pedestal, between the front frame body and the rear frame body;

a support bracket with one end arranged on the pedestal and the other end connected to an upper fixing seat which has an upper engaging room inside, having a containing height of at least 5 cm with a downward opening, and the upper and lower fixing seats to be vertically located along an axis on the pedestal;

a lighting object having at least a transparent bottle being able to emit light effects and to be disposed between the upper and lower fixing seats, corresponding to the height of the window surface;

a first reflection mirror and a second reflection mirror fixed on the rear frame body, located at the rear side of the lighting object and having the reflection surfaces thereof facing forward, and a center thereof serving as a reference to define the first and second reflection mirrors symmetrically, inclined to form an angle θ between 145° and 175°, so that the window surface would display an unlimited extension of an inward serial arrangement from the middle after the contents of the transparent bottle are reflected repeatedly and cumulatively by the first and second reflection mirrors; and a cover plate disposed on the rear frame body, behind the first and second reflection mirrors.

2. The wide-angle lighting display device as claimed in claim 1, wherein the present invention further includes an assembling element arranged between the lighting object and the lower fixing seat, having a hollow engaging room inside to engage with the bottom of the lighting object so that when the upper end thereof is moved upwards to the upper engaging room to a predetermined height, moving the lighting object downwards, making it securely positioned between the upper and lower fixing seats, by which the lighting object can be installed or removed along the vertical axis of the pedestal with the design of the engaging rooms.

3. The wide-angle lighting display device as claimed in claim 1, wherein the lighting object is a water dancing lamp, and the transparent bottle thereof has a base which has a bottom located on the lower fixing seat.

4. The wide-angle lighting display device as claimed in claim 2, wherein the lighting object is a lava lamp or a glitter lamp, and the transparent bottle thereof is filled with heat-sensitive liquid that would flow around and has an inserted section to engage with the assembling element.

5. The wide-angle lighting display device as claimed in claim 4, wherein the present invention further includes a projecting lamp disposed inside the lower fixing seat and obtaining electric power from a power supply disposed inside the pedestal.

6. The wide-angle lighting display device as claimed in claim 5, wherein the projecting lamp includes a bulb or a LED light.

7. The wide-angle lighting display device as claimed in claim 6, wherein the bottom of the transparent bottle contacts with the top of the LED light where a heat conductive paster is arranged thereon in order to conduct the heat to the transparent bottle.

8. The wide-angle lighting display device as claimed in claim 7, wherein the support bracket has a lighting source arranged thereon, and the support bracket is hollow for the power supply to connect to an electric wire through which to supply the electric power for the lighting source.

9. The wide-angle lighting display device as claimed in claim 1, wherein the first and second mirrors behind the rear frame body form an angle θ and have two symmetrical inclined surfaces to form a pre-determined slope when they are joined together.

10. The wide-angle lighting display device as claimed in claim 1, wherein the lower part of the assembling element has an engaging section with shorter diameter than the assembling element in order to engage with the lower fixing seat, and the assembling element has a plurality of heat dissipating holes arranged on the periphery thereof.

* * * * *